US010961704B2

(12) United States Patent
Daudet

(10) Patent No.: US 10,961,704 B2
(45) Date of Patent: Mar. 30, 2021

(54) DRIFT TRACK

(71) Applicant: Larry Randall Daudet, Brentwood, CA (US)

(72) Inventor: Larry Randall Daudet, Brentwood, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 15/969,569

(22) Filed: May 2, 2018

(65) Prior Publication Data

US 2018/0320372 A1 Nov. 8, 2018

Related U.S. Application Data

(60) Provisional application No. 62/501,680, filed on May 4, 2017.

(51) Int. Cl.

| | |
|---|---|
| ***E04B 1/24*** | (2006.01) |
| ***E04B 2/76*** | (2006.01) |
| ***E04B 2/90*** | (2006.01) |
| ***E04B 2/82*** | (2006.01) |
| ***E04B 2/78*** | (2006.01) |

(52) U.S. Cl.
CPC ..... *E04B 2/768* (2013.01); *E04B 2/789* (2013.01); *E04B 2/828* (2013.01); *E04B 2/90* (2013.01)

(58) Field of Classification Search
CPC ..... E04B 2001/2415; E04B 2001/405; E04B 1/2403; E04B 2001/2439; E04B 2001/2448; E04B 2/96; E04B 2/768; E04B 2/88; E04B 2/90; E04B 2/965
USPC ..... 52/235
See application file for complete search history.

(56) References Cited

U.S. PATENT DOCUMENTS

| | | | | |
|---|---|---|---|---|
| 3,038,568 | A | 6/1962 | Morgan | |
| 3,121,978 | A | 2/1964 | Reiland | |
| 3,602,473 | A * | 8/1971 | Van Riet | E04B 9/183 248/317 |
| 3,798,865 | A * | 3/1974 | Curtis | E04B 9/127 403/189 |
| 4,464,074 | A | 8/1984 | Green et al. | |
| 5,720,571 | A * | 2/1998 | Frobosilo | E04B 2/96 403/2 |
| 6,125,594 | A | 10/2000 | Hudson | |
| 6,189,277 | B1 | 2/2001 | Boscamp | |
| 6,213,679 | B1 * | 4/2001 | Frobosilo | E04B 2/82 403/14 |

(Continued)

OTHER PUBLICATIONS

Curtainwall Deflection Solutions, Super Stud Building Products, Inc. Product Catalog, 2001, seven pages including front and back cover, Super Stud Building Products, Inc., Astoria, NY.

(Continued)

*Primary Examiner* — Brian E Glessner
*Assistant Examiner* — Daniel J Kenny
(74) *Attorney, Agent, or Firm* — James R. Cypher; Charles R. Cypher

(57) ABSTRACT

A connection between supporting and supported structural members, particularly between curtain walls and interior support structures, wherein the connector is a member having first portion and a second portion joined at a junction and the second portion is formed with a plurality of elongated slots and the connector rides in a track attached to the first structural member.

23 Claims, 15 Drawing Sheets

(56) References Cited

U.S. PATENT DOCUMENTS 6,612,087 B2 9/2003 diGirolamo et al.
6,688,069 B2 * 2/2004 Zadeh ..... E04B 1/2403 52/712
6,799,407 B2 10/2004 Saldana
7,104,024 B1 * 9/2006 diGirolamo ..... E04B 2/767 403/231
7,216,465 B2 5/2007 Saldana
7,299,593 B1 11/2007 diGirolamo et al.
7,478,508 B2 * 1/2009 Peterson ..... E04B 2/96 248/300
7,503,150 B1 3/2009 diGirolamo et al.
7,752,817 B2 7/2010 Pilz et al.
7,814,710 B2 10/2010 Foglia
8,091,316 B2 * 1/2012 Beck ..... E04B 1/24 52/236.3
8,813,457 B2 * 8/2014 Underkofler ..... E04B 9/30 52/712
8,973,333 B2 * 3/2015 Sugihara ..... E04B 1/2403 52/655.1
9,663,948 B2 * 5/2017 Lehane ..... E04B 9/008
2004/0074197 A1 * 4/2004 Saldana ..... E04B 1/2403 52/712
2008/0053015 A1 3/2008 Matechuk
2009/0193750 A1 8/2009 Klima
2015/0322669 A1 * 11/2015 Shih ..... E04B 1/40 52/698
2018/0135293 A1 * 5/2018 Daudet ..... E04B 2/768
2019/0003178 A1 * 1/2019 Gosling ..... E04B 2/7425

OTHER PUBLICATIONS

Curtain Wall Systems, The Steel Network Inc. Product Catalog, May 2009, four pages including front and back cover, The Steel Network Inc., Durham, NC.

* cited by examiner

DRIFT TRACK

BACKGROUND OF THE INVENTION

The present invention belongs to a class of connectors that are useful in the construction of buildings. The present invention provides an improved connection between two structural members made with a connector and a track.

For a variety of reasons, it is often advantageous to construct walls systems with connectors that permit a degree of relative movement between the different portions of the building. Buildings often settle unevenly on their foundations once they are constructed and this can cause exterior walls to shift with respect to the interior structural elements of the building. Exterior walls of buildings are also subject to deflection from wind or seismic forces. A degree of freedom of movement between different portions of the building can reduce stress and prevent fracture of connected parts, or opening of gaps between parts. Similarly, certain walls are not designed to support vertical loads and must therefore by isolated from the deflection of the primary load-bearing support structure of the building due to changes in live or dead loads carried by that structure.

There are a variety of patented connectors that permit relative movement between different portions of the building. U.S. Pat. Nos. 5,664,392, 6,612,087, 6,688,069 and 8,555,592 all teach metal slip clips with special reinforcing members such as flanges or embossments to strengthen the clip. U.S. Pat. Nos. 5,720,571 and 5,846,018 teach slip clips that use a rivet as the fastener on which sliding between the members occurs. U.S. Pat. Nos. 7,104,024 and 7,503,150 teach connecting sliding fasteners in separate slots of the connector with a u-shaped washer to strengthen the connection between the connector and the structural member to which it is fastened. U.S. Pat. No. 8,511,032 teaches using multiple sliding fasteners in a single slot.

U.S. Pat. Nos. 5,720,571, 6,213,679, 7,104,024, and 7,503,150 teach slip clips that travel in tracks attached to first structural members so that movement along the first structural member is also possible.

The connection of the present invention has been designed to achieve strong load values while being inexpensive to manufacture and install. The connector is formed in such a manner that it can slide easily along the track.

SUMMARY OF THE INVENTION

The present invention provides a connector and track for connecting first and second structural members in a manner that permits bi-directional relative movement between the structural members. The connector has a first portion that is contained within the track or strut and the connector can slide along the track or be fixed in place on the track once the proper location on the track has been determined. The track is preferably fixedly connected to the first building structural member. A second portion of the connector extends outwardly from the first portion and attaches to the second building structural member.

In particular, the present invention provides a connection between a first structural member and a second structural member by means of a slide clip connector and a track. The track is connected to the first structural member. The connector is joined to the track. The connector is also joined to the second structural member by one or more fastenings. The manner in which the connector is joined to the track and to the second structural member allows the second structural member to move relative to the first structural member while providing a strong connection between the first and second structural members. The connector and the track of the present invention are preferably made from cold-formed steel. The upper and the lower sides of the second portion of the connector can be provided with flanges or contours that extend at an angle to the second portion of the connector.

The present invention provides a simple connection between the connector and the track while still providing the designed-for freedom of movement between the first and second structural members. According to the present invention, the connection between the connector and the track can be made with a connector having a first portion having multiple tabs extending in opposing directions that hook underneath the lips of the track. The connection has a first structural member and a second structural member. A track is connected to a first structural member. The track is generally c-shaped and includes a web and a pair of opposed side flanges that extend in parallel relationship and at an angle to the web. The flanges have lips that extend at an angle to the side flanges and toward each other. A first connector is received in the track and connects the first structural member to the second structural member. The first connector has a first portion contained in the track. The first connector also has a second portion extending outwardly from the first portion which is fastened to the second structural member. The first portion of the connector is joined to the second portion by a neck with both the first portion and the second portion flaring laterally from the neck. The second structural member has an attachment face and the second portion of the connector is connected to the attachment face of the second structural member. The first portion of the connector is formed with first and second opposed tabs, with the first tab extending underneath the upper lip of the track and the second opposed tab extending under the lower lip of the track, and the first and second opposed tabs are formed with bent flanges that extend in opposed directions away from the attachment face of the second structural member.

The present invention provides the connector with upper and lower projecting members that help keep the connector disposed orthogonally to the track, so that the connector can slide easily along the track. The connection includes a first structural member joined to a second structural member. A track is connected to the first structural member, the track being of a generally c-shape and including a web and a pair of opposed side flanges that extend in parallel relationship and at an angle to the web. The flanges having lips that extend at an angle to the side flanges and toward each other. A connector joins the first structural member to the second structural member. The first connector has a first portion contained in the track. The first connector also has a second portion extending outwardly from the first portion and fastened to said second structural member. The first portion is joined to the second portion by a neck with both the first portion and the second portion flaring laterally from the neck. The connector is also formed with one or more projecting members that extend from the second portion and overlie the outer surfaces of the upper and lower flanges of the track or the outer surfaces of the lips to stabilize the connector. The upper and lower projecting members can extend in opposed directions away from the attachment face of the second structural member such that the upper and lower projecting members form a T-shaped member with the second portion of the connector. The second portion of the connector can be formed with an upper side and a lower side, and a proximal end that is closer to the first portion and a distal end that is disposed farther away from the first portion than the proximal end, and the second portion can also be formed with an upper projecting member that extends from the proximal end of the second portion and the upper side and with a lower projecting member that extends from the proximal end of the second portion and the lower side.

DETAILED DESCRIPTION OF THE INVENTION

Figure 1:
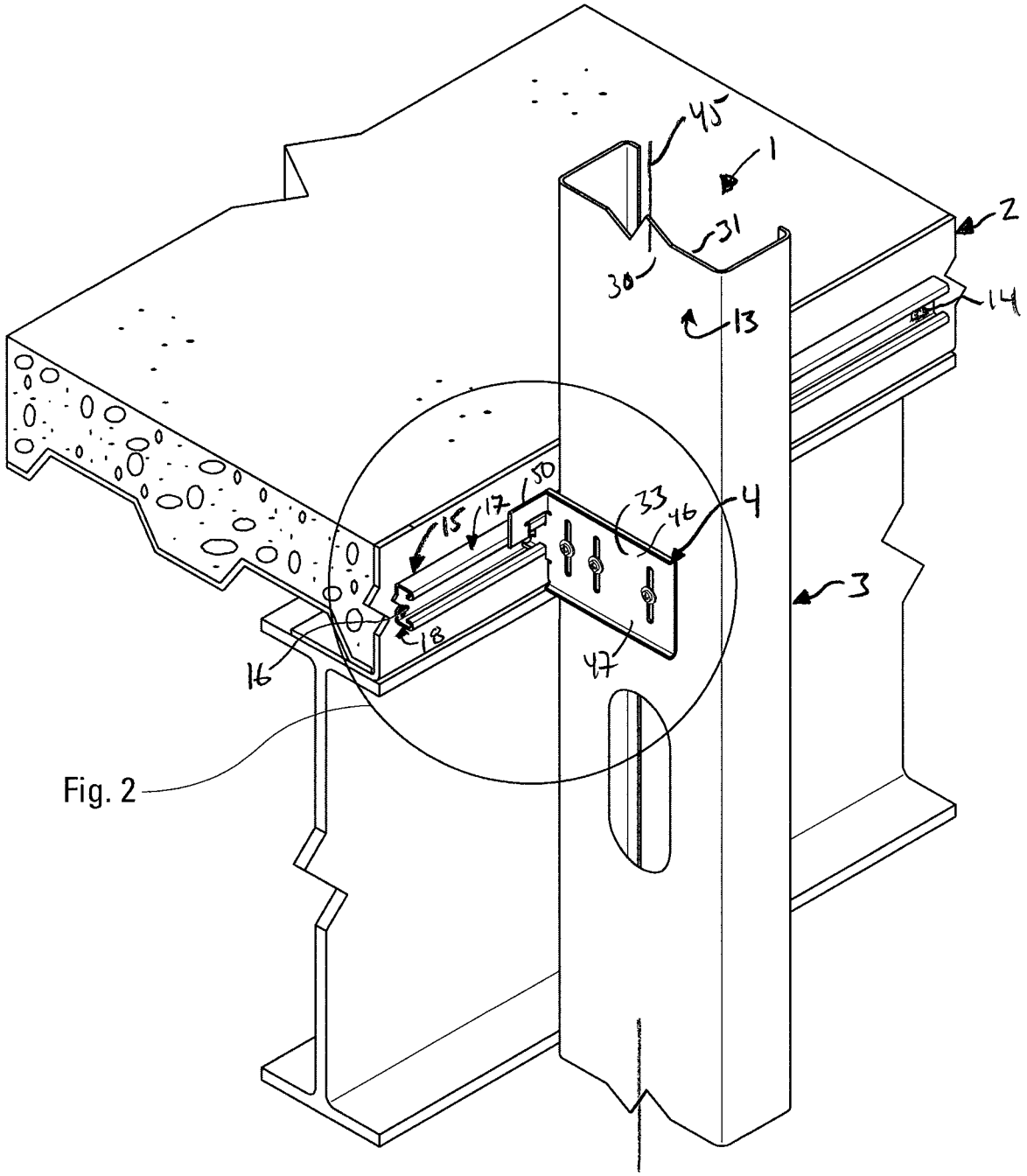
FIG. 1 is a perspective view of a wall stud to floor member connection formed according to the present invention.

The present invention is a building structural connection 1 between a first structural member 2 and a second structural member 3. Preferably, the first structural member 2 is a supporting member or anchoring member 2 and the second structural member 3 is a supported structural member 3. As shown in FIG. 1, the first structural member 2 is a floor member 2 that is horizontally disposed and the second structural member 3 is a vertically-oriented wall post or stud 3 that is part of a wall. Although in the preferred embodiment, the connecter is used as shown in FIG. 1, the first structural and second structural members 2 and 3 could be oriented in a different manner. The following description refers to upper and lower members and portions as oriented with respect to each other. This is in no way meant to limit the manner in which the connector 4 can be used, but it is merely for ease of understanding of the invention. The second structural member or stud 3 is preferably channel-shaped as shown in the drawings.

The connection 1 between the first structural member 2 and the second structural member 3 is made with a connector 4. The connector 4 has a first portion 5 and a second portion 6 fastened to the second building structural member 3. Preferably, the second portion 6 has a generally planar section. The manner in which the connector 4 is attached to the second structural member 3 allows for relative vertical movement between the first and second building structural members 2 and 3. The connector 4 is preferably made from cold formed sheet steel formed on automated manufacturing machinery as much as possible.

Figure 2:
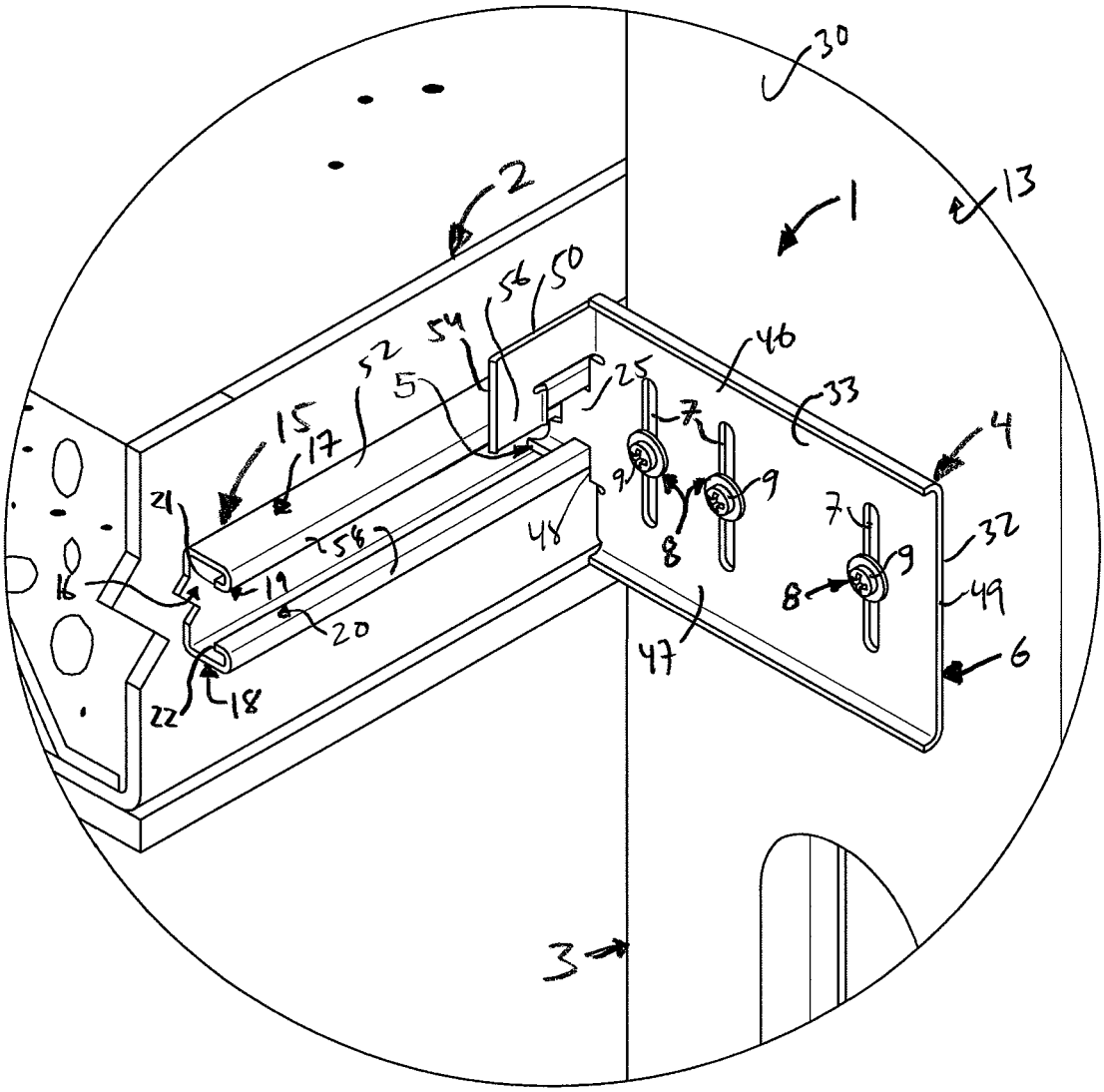
FIG. 2 is a close-up perspective view of the connection of FIG. 1.

As shown in FIG. 2, the second portion 6 has first fastener openings 7 formed as elongated slots. The slotted openings 7 are preferably disposed parallel to each other. Each elongated slot 7 in the second portion 6 can be a site of a fastening to the second structural member 3.

A plurality of fasteners 8 preferably attaches the second portion 6 to the second building structural member 3. Preferably, the fasteners 8 that attach the second portion 6 to the second building structural member 3 are screws 8 of similar dimensions. The preferred fasteners 8 for attaching the connector 4 through slots 7 are shouldered, or stepped-shank, self-drilling screws 8.

As shown in FIG. 1, the fastener openings 7 are preferably formed as a plurality of elongated slots 7 in the second portion 6 as movement between the structural member 3 and the connector 4 is desired. When the fastener 8 is drilled into or connected to the stud or second structural member 3, the fastener 8 is anchored in the stud 3. When the stud 3 moves relative to the first structural member 2 the fastener 8 moves in the elongated slot 7. The second building structural member 3 is preferably fastened to the connector 4 so that the second building structural member 3 can move relative to the second portion 6 of the connector 4.

Preferably, the fasteners 8 are shouldered, or stepped-shank screws 8. Shouldered screws 8 preferably have a head 9, an unthreaded shank portion 10 immediately below the head 9, a threaded shank portion 11 below the unthreaded shank portion 10, and a tip 12. The tip 12 is preferably a self-drilling tip. The unthreaded shank portion 10 allows the second building structural member 3 and the fasteners 8 attached to it to move relative to the second portion 6 without interference between the fastener 18 and the second portion 6 of the first connector 4, because the unthreaded shank portion 10 stops driving of the fastener 8 before the head 9 of the fastener 8 reaches the second portion 6 or engages it too tightly. Similarly, a washer or sleeve could be provided around the shank portion 11 of the screw 8 where the washer holds the head 9 of the screw 8 away from the second portion 6 when the bottom of the sleeve or washer engages the second building structural member 3. The tip 12 is designed to drill itself into the web 13 of the stud 3. The web 13 of the stud 3 is preferably a substantially planar member.

The track 15 is connected to the first structural member 2. The preferred fasteners for attaching the track 15 to a first structural member 2 made from steel are hex-head, threaded fasteners, automated power-actuated gun-driven fasteners or, alternatively, welds. The preferred fasteners 14 for attaching the track 15 to a first structural member 2 made from concrete are concrete screws. Preferably, the first building structural member 2 is fastened to the track 15 so that the first building structural member 2 cannot move relative to the track 15.

The elongated track 15 is generally C-shaped and includes a web 16 and outer flanges 17 and 18 with lips 19 and 20 that preferably curl over so as to define a track 15. The flanges 17 and 18 extend outwardly in the same direction from the web 16 of the track 15. The lips 19 and 20 attached to the flanges 17 and 18 turn-in towards each other, and preferably curl over so that the end faces 21 and 22 of the lips 19 and 20 face the web 16 of the track 15. The lips 19 and 20 are generally disposed parallel to the portion of the web 16 of the track 15 over which they lie. As shown in the drawings, the track 15 is an elongated straight member, but the track 15 could be curved with the web 16 being curved or the outer flanges 17 and 18 being curved. The lips 19 and 20 are preferably formed as a continuous 180 degree bends in the track 15. The track 15 is preferably fixedly secured to the first structural member 2.

The first portion 5 of the connector 4 is contained within the channel defined by the web 16, flanges 17 and 18 and lips 19 and 20 of the elongated track 15 and is able to slide back and forth therein. The first portion 5 of the connector 4 is disposed such that the outer flanges 17 and 18 and lips 19 and 20 of the track curl around and confine the first portion 5 within the elongated track 15. The second portion 6 extends outwardly from the track. Notches 23 and 24 are provided in the connector 4 between the first portion 5 and the second portion 6 to create a neck 25 that can be received between the lips 19 and 20 of the outer flanges 17 and 18. The neck 25 joins the first portion 5 to the second portion 6. The lips 19 and 20 extend into the notches 23 and 24 of the connector 4. The notches 23 and 24 are dimensioned so the lips 19 and 20 can slide freely through the notches 23 and 24 when the second portion 6 is disposed substantially orthogonally to the web 16 of the track 15.

The first portion 5 of the connector 4 is joined to the second portion 6 by the neck 25 with both the first portion 5 and the second portion 6 flaring laterally from the neck 25. The second portion 6 extends longitudinally or outwardly from the first portion 5 with the neck disposed between the first portion 5 and the second portion 6.

The second structural member 3 preferably has an attachment face 30 and an opposite face 31, and the second portion 6 has an attachment face 32 and an open face 32 facing in the opposite direction. The attachment face 32 of the second portion 6 faces the second building structural member 3. The connector 4 is preferably disposed on the attachment face 30 of the stud 3 as shown in FIG. 1. Preferably, the attachment face 32 of the second portion 6 interfaces with the attachment face 30 of the second structural member 3.

Figure 3:
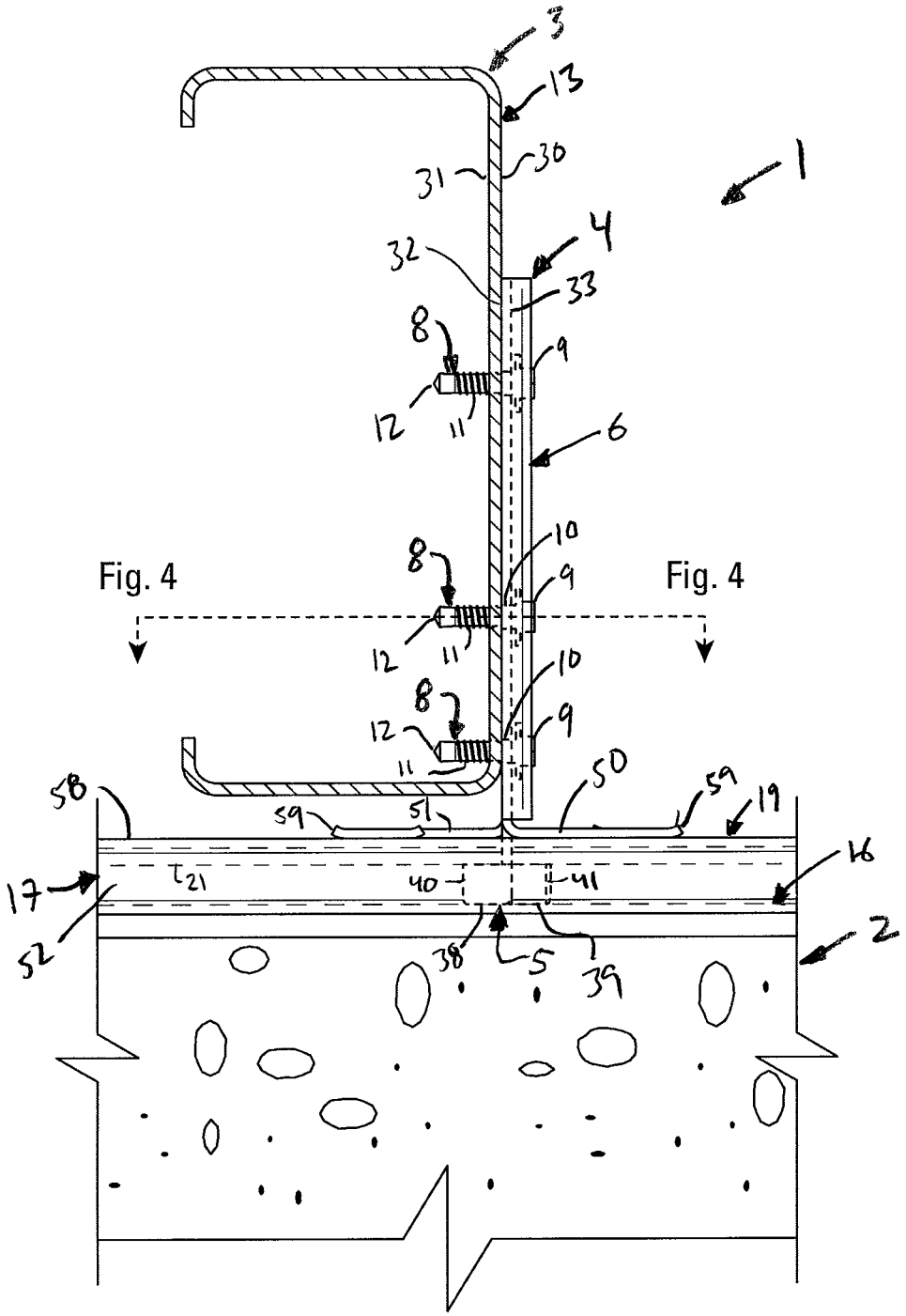
FIG. 3 is a top view of the connection shown in FIG. 1.
Figure 6:
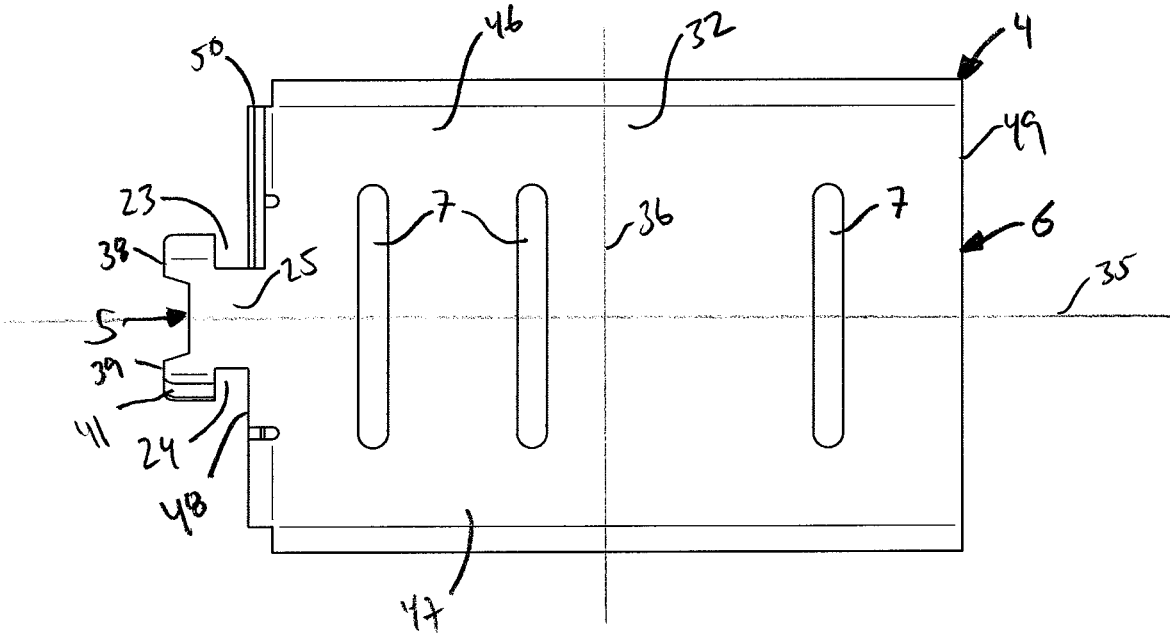
FIG. 6 is a back view of the connector of FIG. 5.
Figure 8:
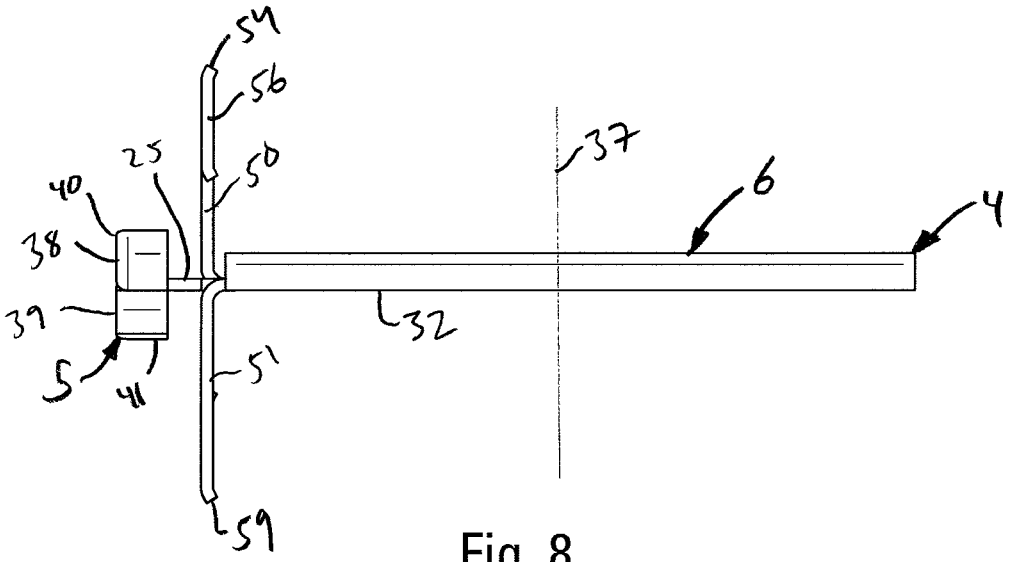
FIG. 8 is a bottom view of the connector of FIG. 5.
Figure 9:
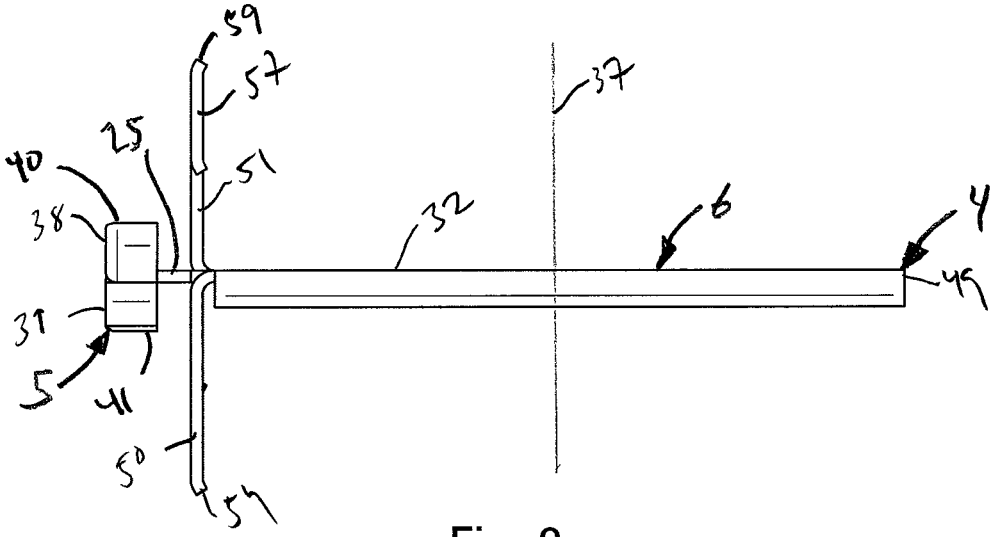
FIG. 9 is a top view of the connector of FIG. 5.
Figure 10:
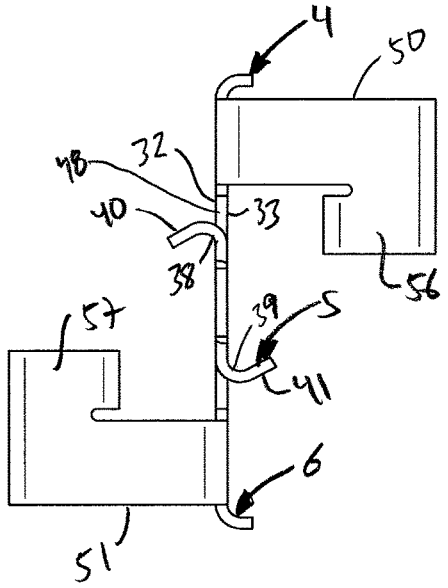
FIG. 10 is a left end view of the connector of FIG. 5.
Figure 11:
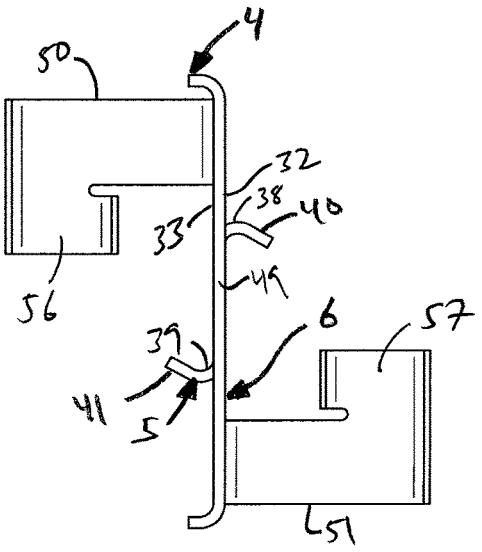
FIG. 11 is a right end view of the connector of FIG. 5.

As shown in FIG. 6, the second portion 6 of the connector 4 extends outwardly and longitudinally away from the first portion 5 of the connector 4 along a longitudinal axis 35 of the connector 4, and the first portion 5 and the second portion 6 flare laterally away from the narrower neck 25 of the connector 4 along a lateral axis 36 of the connector 4. The connector also has a depth axis 37 as shown in FIGS. 8 and 9. As shown in FIG. 3, the fasteners 8 that attach the connector 4 to the second structural member 3 extend along the depth axis 37.

Figure 4:
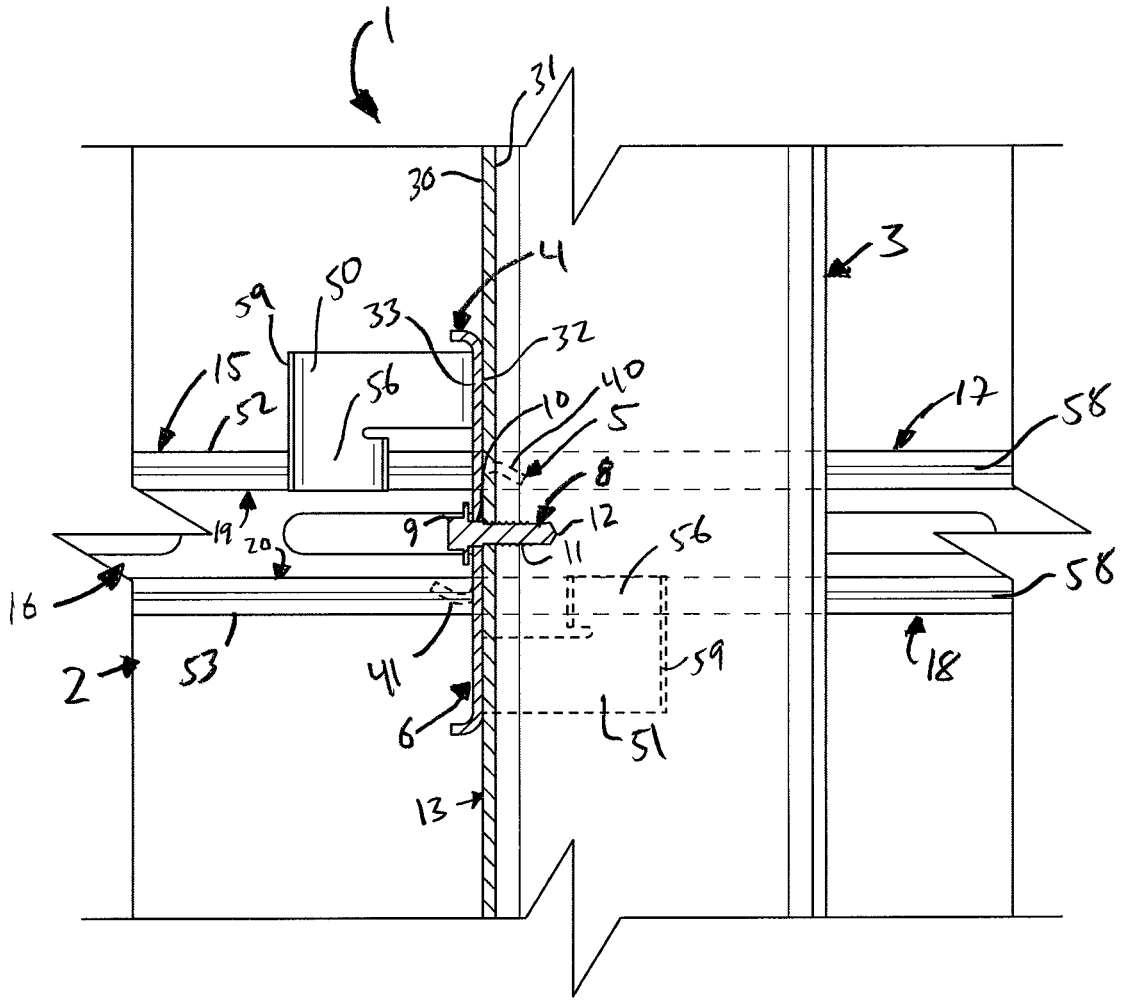
FIG. 4 is a front, sectional view of the connection of FIG. 1.
Figure 5:
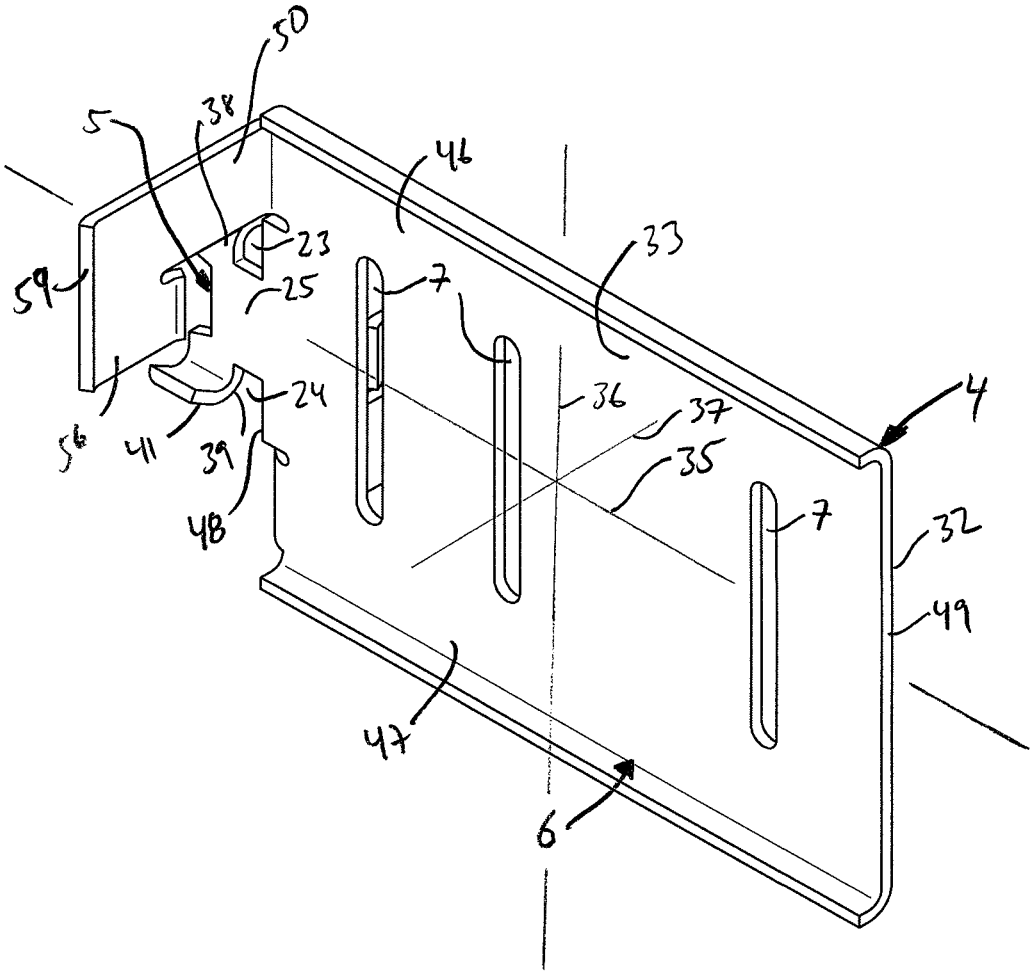
FIG. 5 is a perspective view of the connector shown in FIG. 1.
Figure 7:
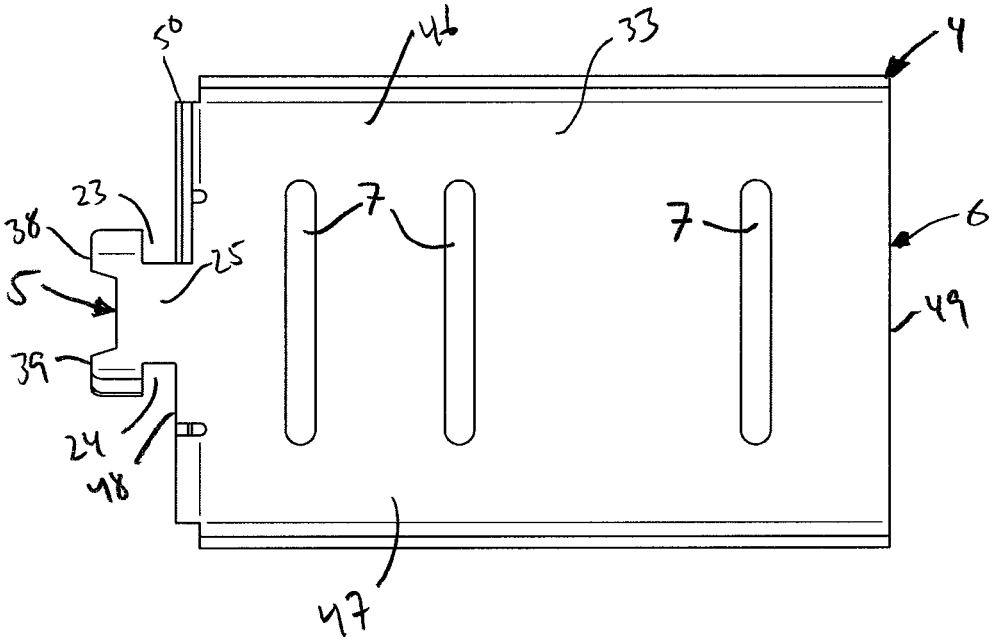
FIG. 7 is a front view of the connector of FIG. 5.

As noted above and as shown in FIGS. 3 and 4, the second structural member 3 has an attachment face 30 and the second portion 6 of the connector 4 is connected to the attachment face 30 of the second structural member 3. As shown in FIGS. 7, 8 and 9, the first portion 5 of the connector 4 is formed with first and second opposed tabs 38 and 39, with the first tab 38 extending underneath the upper lip 19 of the track 15 and the second opposed tab 39 extending under the lower lip 20 of the track 15, and the first and second opposed tabs 38 and 39 are formed with bent flanges 40 and 41 that extend in opposed directions away from the attachment face 30 of the second structural member 3 such that the tabs 38 and 39 and flanges 40 and 41 of the lower portion 5 form a T-shaped member with the neck 25 projecting from the second portion 6 of the connector 4. Bent flanges 40 and 41 extend along the depth axis 37 of the connector 4. As shown in FIGS. 5, 8 and 9, portions of tab 38 and bent flange 40 are disposed on the same side of second portion 6 as the attachment face 32, and portions of tab 39 and bent flange 41 are disposed on the same side of second portion 6 as the open face 33. This orientation can be reversed.

As shown in FIG. 1, the second structural member 3 has a longitudinal axis 45 and the second structural member 3 is elongated along the longitudinal axis 45, and the second portion 6 of the connector is formed with a upper side portion 46 and a lower side portion 47, and the upper side portion 46 lies above the lower side portion 47 on the longitudinal axis 45 of the second structural member 3, and the upper and lower side portions 46 and 47 of the second portion 6 are provided with bends or flanges that extend at an angle to the second portion 6 of the connector 4 or protrude from the body of the second portion 6 of the connector 4 along the depth axis 37 of the connector 4 to strengthen the connector 4.

As shown in FIG. 5, the second portion 6 of the connector is formed with an upper side portion 46 and a lower side portion 47, and a proximal end 48 that is closer to the first portion 4 and a distal end 49 that is disposed farther away from the first portion 5 than the proximal end 48, and the second portion 6 is formed with an upper projecting member 50 that extends from the proximal end 48 of the second portion 6 and the upper side portion 46, and the second portion 6 is formed with a lower projecting member 51 that extends from the proximal end 48 of the second portion 6 and the lower side portion 47. Preferably, the upper side portion 46 extends laterally away from the longitudinal axis 35 of the connector 4 such that the upper side portion 46 extends laterally beyond the upper flange 17 of the track 15, the lower side portion 47 extends laterally away from the longitudinal axis 35 of the connector 4 such that the lower side portion 47 extends laterally beyond the lower flange 18 of the track 15. Preferably, the track 15 is much narrower than the connector 4, with the first portion 5 of the connector 4 being much narrower than the second portion 6 of the connector 4.

Figure 12:
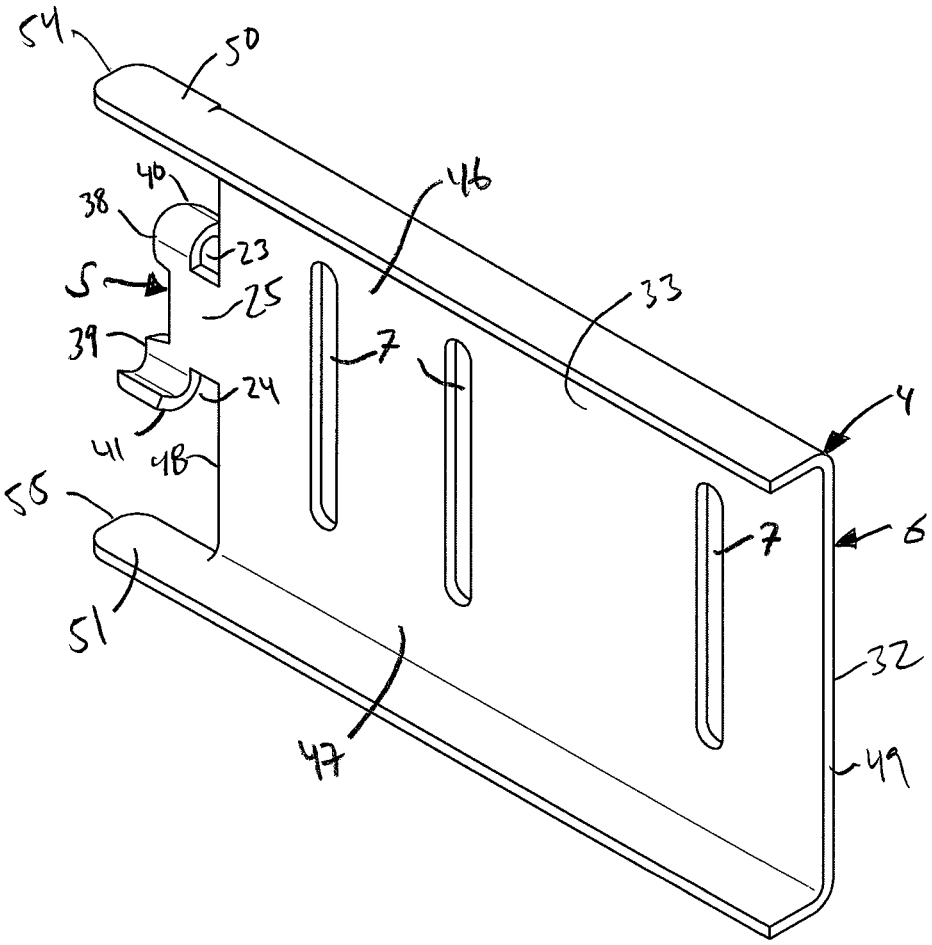
FIG. 12 is a perspective view of an alternate embodiment of the connector of the present invention.

As shown in FIG. 12, the upper and lower projecting members 50 and 51 can extend from the proximal end 48 of the second portion and alongside the first portion 5 of the connector 4, such that the upper and lower projecting members 50 and 51 can also extend alongside the upper and lower flanges 17 and 18 of the track 15, either making contact with the flanges 17 and 18 or being closely adjacent to them. Inside surfaces of the upper and lower projecting members 50 and 51 may be designed to slide along the outer surfaces 52 and 53 of the upper and lower flanges 17 and 18 of the track 15 to help keep the connector 4 disposed orthogonally to the track 15. The ends 54 and 55 of the upper and lower projecting members 50 and 51 may be squared off so they provide a linear surface that can interface with a linear surface of the first structural member 2 and thereby help keep the connector 4 disposed orthogonally to the track 15.

As shown in FIG. 3, the upper and lower projecting members 50 and 51 can extend from the proximal end 48 of the second portion and along the upper and lower lips 19 and 20 of the track 15. As shown in FIG. 3, the upper and lower projecting members 50 and 51 can extend in opposed directions away from the attachment face 30 of the second structural member 3 such that the upper and lower projecting members 50 and 51 together with the second portion 6 of the connector 4 form a T-shaped member. Upper and lower projecting members 50 and 51 extend along the depth axis 37 of the connector 4. As shown in FIGS. 5, 8 and 9, lower projecting member 51 is disposed on the same side of second portion 6 as the attachment face 32, and upper projecting member 50 is disposed on the same side of second portion 6 as the open face 33. Preferably, the upper projecting member 50 extends in an opposite direction from first tab 38 and first tab flange 40, and the lower projecting member 51 extends in an opposite direction from the second tab 38 and second tab flange 41. Preferably, the upper and lower projecting members 50 and 51 are not fixedly connected to the track 15 so that the connector 4 may slide along the track 15.

As shown in FIG. 5, the upper and lower projecting members 50 and 51 are preferably formed with upper and lower extensions or skids 56 and 57 that are disposed inwardly toward the longitudinal axis 35 of the connector 4. The upper and lower extensions 56 and 57 make contact with the upper and lower lips 19 and 20 and slide along the lips 19 and 20 if the connector 4 moves in the track 15. Preferably, the upper and lower extensions 56 and 57 make contact with the outer surfaces 58 of the lips 19 and 20. Inside surfaces of the upper and lower projecting members 50 and 51 may be designed to slide along the outer surfaces 58 of the lips 19 and 20 of the track 15 to help keep the connector 4 disposed orthogonally to the track 15, either making contact with the flanges 19 and 20 or being closely adjacent to them. This bracing of the connector 4 against the lips 19 and 20 of the track 15 helps keep the connector 4 oriented in a manner that allows for movement along the track 15. As shown in FIG. 5, preferably, the upper and lower extensions 56 and 57 are formed with upturned ends 59 that facilitate movement along the track 15. The edges of the lower member 5, the upper and lower notches 23 and 24 and the portions of the proximal end 48 of the second portion 6 can be coined or rounded or smoothed where they would make contact with the track 15 to encourage sliding of the connector 4 along the track 15, and prevent binding.

Figure 13:
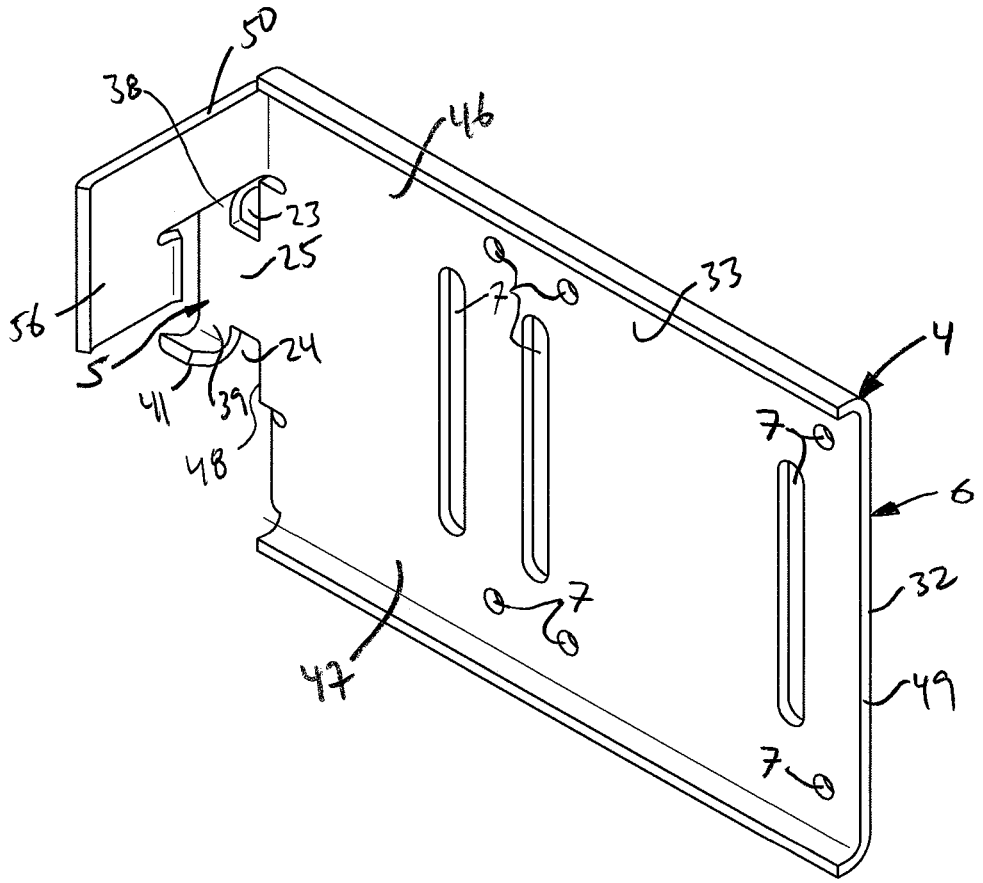
FIG. 13 is a perspective view of an alternate embodiment of the connector of the present invention.
Figure 14:
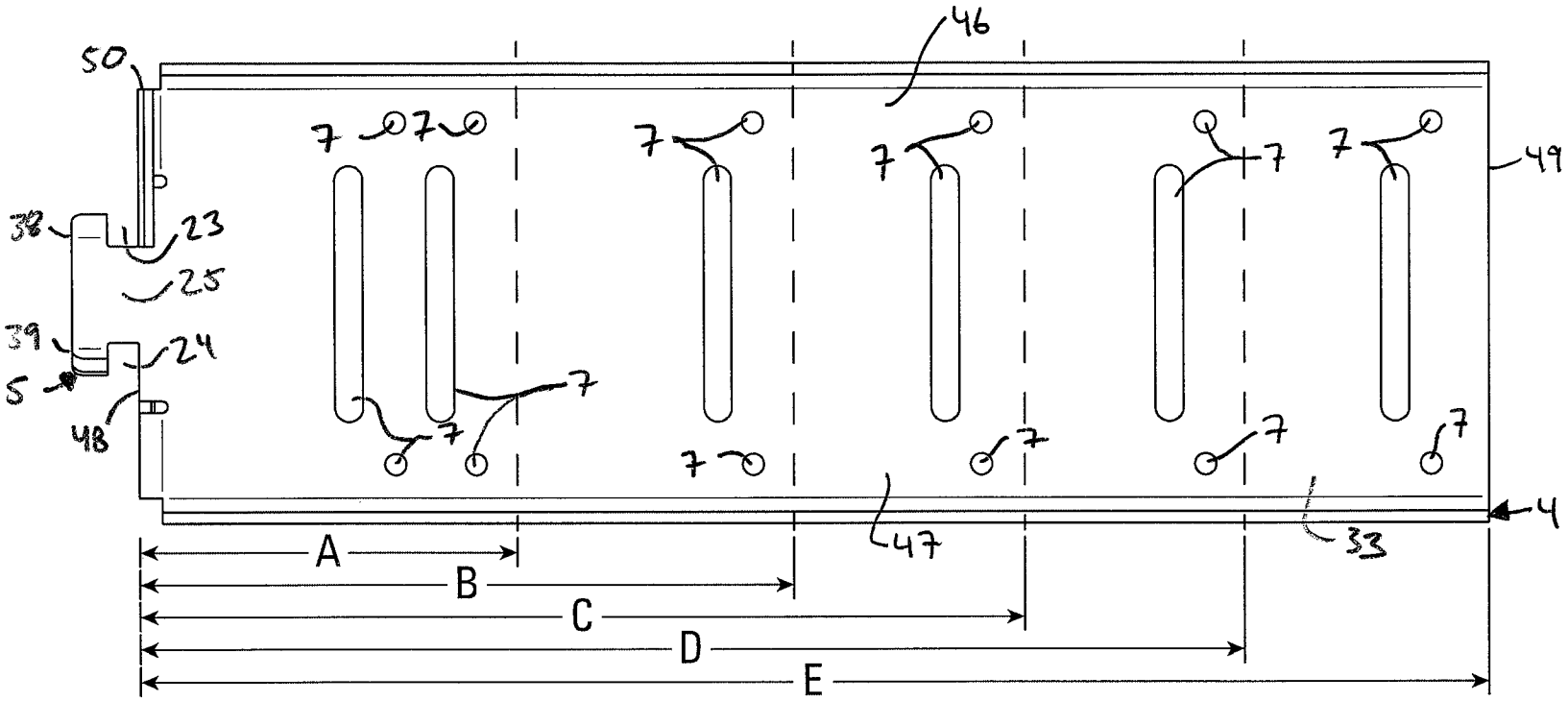
FIG. 14 is a front view of an alternate embodiment of the connector of the present invention.

As shown in FIGS. 13 and 14, the connector 4 can be made with a plurality of elongated slots 7 and round openings 7 for fasteners 8 in the second portion 6. The connector 4 can also be made in differing lengths. In FIGS. 13 and 14 the arrows labeled A represent the shortest version of the connector 4 with the least number of fastener openings 7 in the second portion 6, and arrows B-E represent longer versions of the connector 4 that can be made with the same lower portion 5 and proximal end 48.

Figure 15:
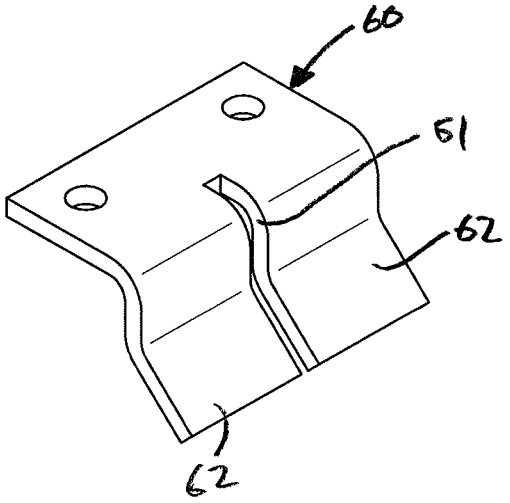
FIG. 15 is a perspective view of a clip that can be used as part of the present invention to hold the connector in place on the track.
Figure 16:
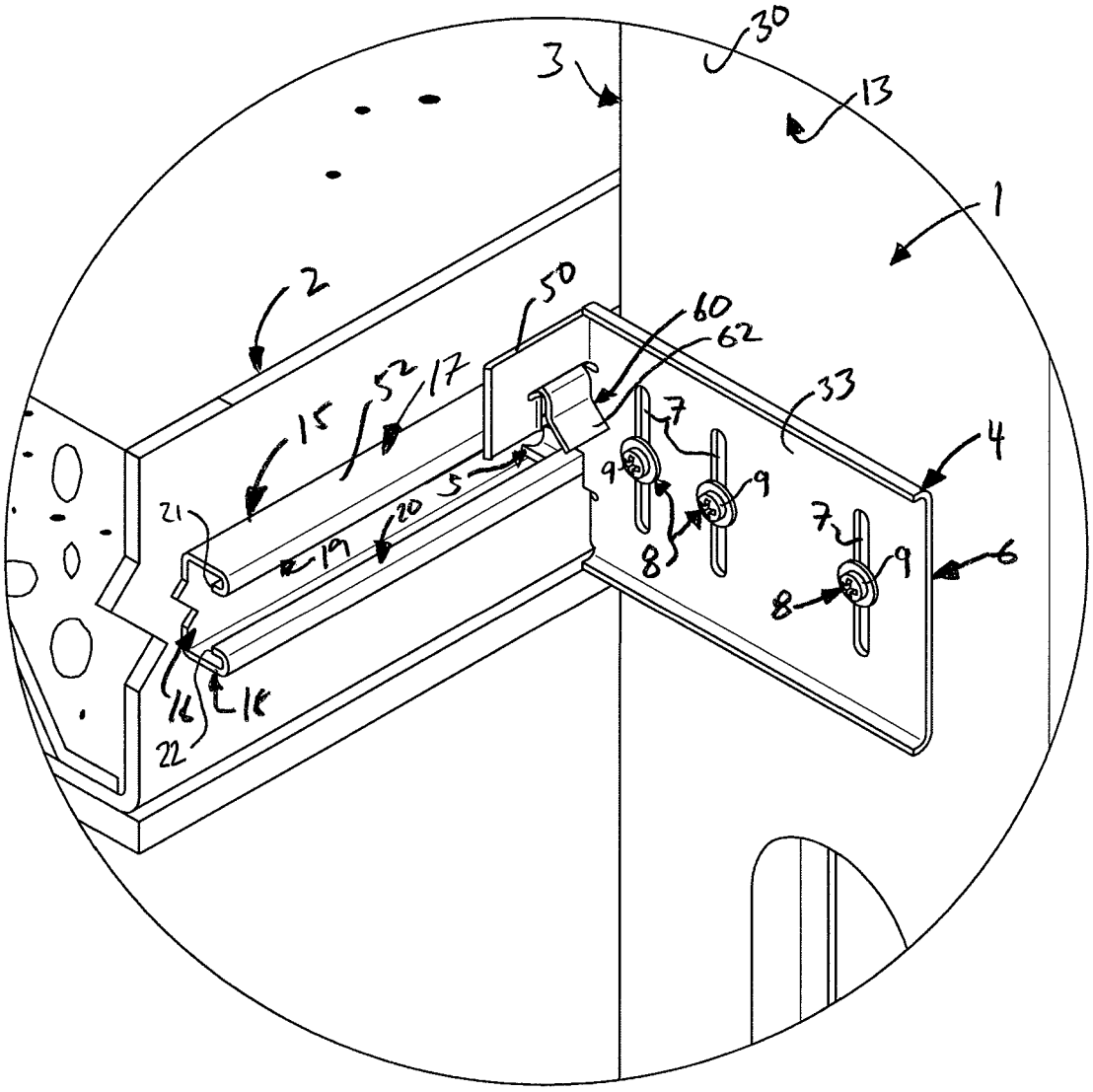
FIG. 16 is a perspective view of a wall stud to floor member connection formed according to the present invention with the clip of FIG. 15 in place to hold the connector in place on the track.
Figure 17:
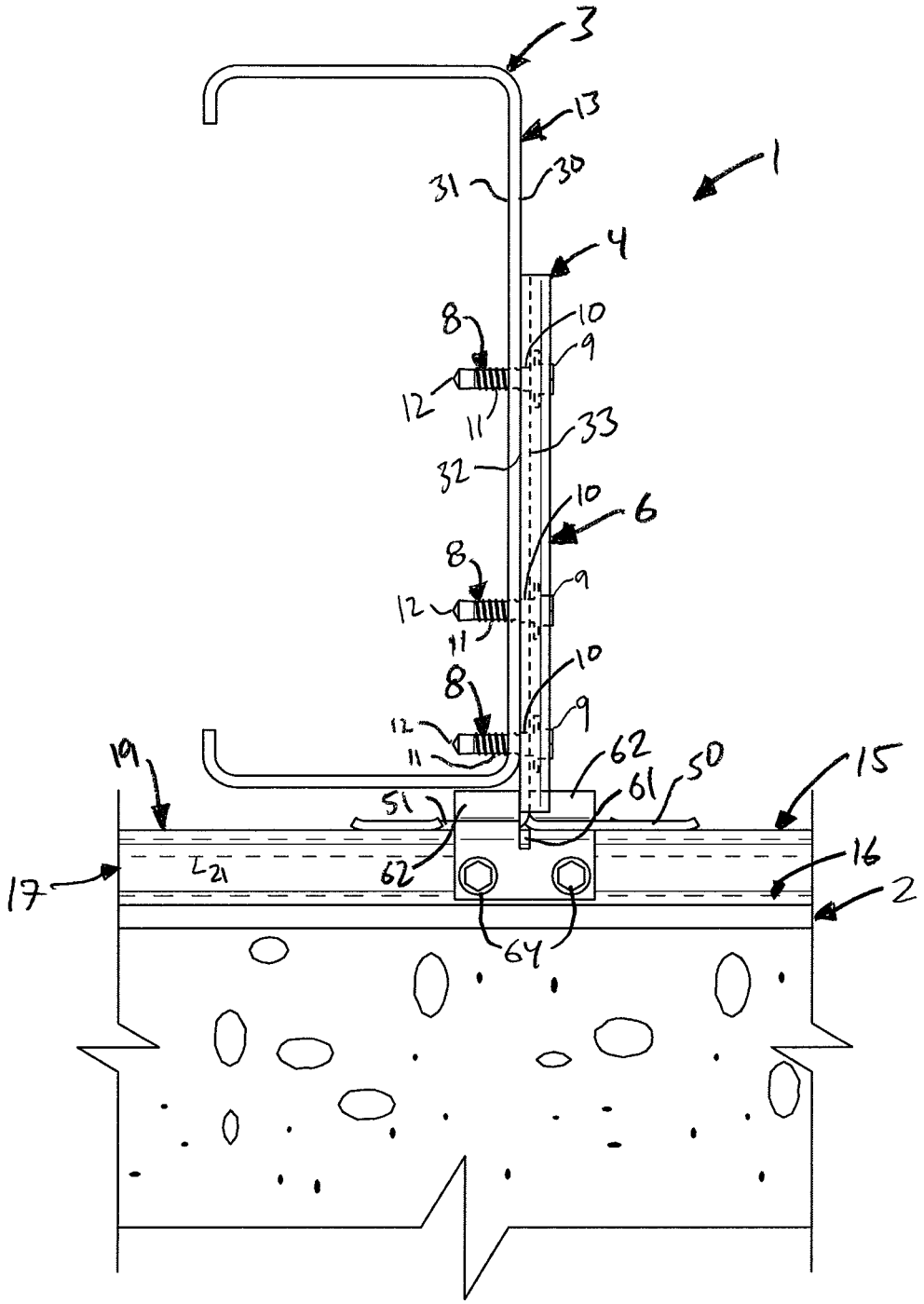
FIG. 17 is a top view of the connection shown in FIG. 16.

As shown in FIGS. 15 through 17, the connector 4 can be used with a notched clip 60 to hold the connector 4 in place with respect to the track 15. The clip 60 is fastened to the upper or lower flange 17 or 18 of the track 15 with the second portion 6 of the connector 4 received in the notch 61 between prongs 62 and 63. Fasteners 64 such as screws can be driven through the clip 60 to attach it to the track.

The connector 4 is placed in the track 15 by inserting the first portion 5 at an angle, and then rotating the connector 4 so that the opposed tabs 38 and 39 are received underneath the lips 19 and 20. The connector 4 is then attached to the supported structural member 3 by driving one or more, preferably shouldered fasteners 8 through the one or more fastener openings 7 in the second portion 6.

I claim:

1. A building structural connection comprising:

a. a first structural member;

b. a second structural member;

c. a track connected to a first structural member, the track being of a generally c-shape and including a web and a pair of opposed outer flanges that extend in the same direction at an angle to the web, one of the opposed outer flanges being an upper flange and one of the opposed outer flanges being a lower flange, the upper and lower flanges having respective upper and lower lips that extend at an angle to the outer flanges and toward each other;

d. a connector, connecting said second structural member to said first structural member, the connector having a first portion contained in the track, the connector also having a second portion extending outwardly from the first portion and in line with the first portion along a longitudinal axis of the connector and fastened to said second structural member, wherein the first portion is joined to the second portion by a neck with both the first portion and the second portion flaring laterally from the neck along a lateral axis of the connector, wherein:

e. the second structural member has an attachment face and the second portion of the connector is connected to the attachment face of the second structural member, and the first portion of the connector is formed with first and second opposed tabs, with the first tab extending underneath the upper lip of the flange lips of the track and the second opposed tab extending under the lower lip of the flange lips of the track, and the first and second opposed tabs are formed with bent flanges that extend in opposed directions away from the attachment face of the second structural member and away from each other; wherein f. the connector is formed with upper and lower projecting members that extend from the second portion and overlie outer surfaces of the upper and lower flanges of the track or outer surfaces of the upper and lower lips to stabilize the connector, and the upper and lower projecting members extend in opposed directions away from the attachment face of the second structural member such that the upper and lower projecting members form a T-shaped member with the second portion of the connector.

2. The building structural connection of claim 1, wherein:

the second portion of the connector is joined to the second structural member in a manner that allows the second portion of the connector to move with respect to the second structural member while still being attached.

3. The connection of claim 1, wherein:

said second portion has a plurality of fastener openings that receive fasteners that connect the second portion to the second structural member, and said plurality of fastener openings are formed as a plurality of substantially parallel elongated slots in said second portion of said connector and at least two of the plurality of elongated slots in said second portion is a site of a fastening to the second structural member, and at least two of the plurality of elongated slots receives at least one fastener having an elongated shank and a head, wherein the elongated shank of each fastener is received in the second structural member, and each at least one fastener can move along the elongated slot in the second portion when the second structural member moves with respect to the second portion.

4. The building structural connection of claim 3, wherein:

each of the plurality of elongated slots in the second portion is the site of a fastening to the second structural member.

5. The building connection of claim 1, wherein:

a. the second structural member has a longitudinal axis and the second structural member is elongated along the longitudinal axis;

b. the second portion of the connector is formed with an upper side and a lower side, and the upper side lies above the lower side on the longitudinal axis of the second structural member; and c. the upper and the lower sides of the second portion are provided with flanges or contours that extend at an angle to the main portion of the second portion of the connector.

6. The building structural connection of claim 5 wherein:

said fasteners that attach said second portion to said second structural member are shouldered screws.

7. The building connection of claim 1, wherein:

the lips attached to the flanges curl or bend over so that end faces of the lips face the web of the track.

8. The building connection of claim 1, wherein:

a. the second portion of the connector is formed with an upper side and a lower side, and a proximal end that is closer to the first portion and a distal end that is disposed farther away from the first portion than the proximal end, and b. the upper projecting member extends from the proximal end of the second portion and the upper side, and the lower projecting member extends from the proximal end of the second portion and the lower side.

9. The building structural connection of claim 1 wherein:

said fasteners that attach said second portion to said second structural member are screws.

10. The building structural connection of claim 1, wherein:

a. said first structural member is a horizontally disposed member that is a floor member of a structure, and b. said second structural member is a vertically disposed member that is part of a wall.

11. The connection of claim 10, wherein:

said second portion has a plurality of fastener openings that receive fasteners that connect the second portion to the second structural member, and said plurality of fastener openings are formed as a plurality of substantially parallel elongated slots in said second portion of said connector and at least two of the plurality of elongated slots in said second portion is a site of a fastening to the second structural member, and at least two of the plurality of elongated slots receives at least one fastener having an elongated shank and a head, wherein the elongated shank of each fastener is received in the second structural member, and each at least one fastener can move along the elongated slot in the second portion when the second structural member moves with respect to the second portion.

12. The building structural connection of claim 1, wherein:

the first portion of the connector is joined to the track in a manner that allows the first portion of the connector to move with respect to the track.

13. The building structural connection of claim 1, wherein:

the first structural member is fastened to the track so that the first structural member cannot move relative to the track.

14. The building structural connection of claim 1, wherein:

the upper and lower projecting members are not fixedly connected to the track so that the connector may slide along the track.

15. The building structural connection of claim 1, wherein:

the upper and lower projecting members are formed with upper and lower extensions that are formed with upturned ends.

16. The building structural connection of claim 1, wherein:

the upper and lower portions of the connector are smoothed where they make contact with the track.

17. The building structural connection of claim 1, wherein:

a clip having a plurality of prongs with one or more notches between the prongs is fastened to the upper or lower flange of the track with the second portion of the connector received in one of the notches between the prongs.

18. The building structural connection of claim 1, wherein:

the upper projecting member extends in an opposite direction from first tab and first tab flange, and the lower projecting member extends in an opposite direction from the second tab and second tab flange.

19. A building structural connection comprising:

a. a first structural member;

b. a second structural member;

c. a track connected to the first structural member, the track being of a generally c-shape and including a web and a pair of opposed outer flanges that extend in the same direction and at an angle to the web, one of the opposed outer flanges being an upper flange and one of the opposed outer flanges being a lower flange, the upper and lower flanges having respective upper and lower lips that extend at an angle to the outer flanges and toward each other;

d. a connector, connecting said second structural member to said first structural member, the connector having a first portion contained in the track, the connector also having a second portion extending outwardly from the first portion and in line with the first portion along a longitudinal axis of the connector and fastened to said second structural member, wherein the first portion is joined to the second portion by a neck with both the first portion and the second portion flaring laterally from the neck along a lateral axis of the connector, wherein:

e. the connector is formed with one or more projecting members that extend from the second portion and overlie the outer surfaces of the upper and lower flanges of the track or the outer surfaces of the lips to stabilize the connector.

20. The building connection of claim 19, wherein:

the first portion of the connector is formed with first and second opposed tabs, with the first tab extending underneath the upper lip of the flange lips of the track and the second opposed tab extending under the lower lip of the flange lips of the track.

21. The building connection of claim 20, wherein:

a. the second structural member has an attachment face and the second portion of the connector is connected to the attachment face of the second structural member; and b. the first and second opposed tabs are formed with bent flanges that extend in opposed directions away from the attachment face of the second structural member and away from each other.

22. The building structural connection of claim 19, wherein:

the second portion of the connector is joined to the second structural member in a manner that allows the second portion of the connector to move with respect to the second structural member while still being attached.

23. The building connection of claim 19, wherein:
the lips attached to the flanges curl or bend over so that end faces of the lips face the web of the track.

* * * * *